US005358282A

United States Patent [19]

Giambruno et al.

[11] Patent Number: 5,358,282

[45] Date of Patent: Oct. 25, 1994

[54] OPTICAL NIGHT SKY IMAGEER

[76] Inventors: Anthony J. Giambruno, 42 Storey La., Yonkers, N.Y. 10710; Frank Marocco, 10 Stewart Pl., Apt. 7-D-W, White Plains, N.Y. 10603

[21] Appl. No.: 21,479

[22] Filed: Feb. 22, 1993

[51] Int. Cl.[5] ..... B42D 15/00

[52] U.S. Cl. ..... 283/117

[58] Field of Search ..... 283/117

[56] References Cited

U.S. PATENT DOCUMENTS 5,098,129 3/1992 Haber ..... 283/117 X

*Primary Examiner*—Paul A. Bell

*Attorney, Agent, or Firm*—Richard L. Miller

[57] ABSTRACT

An imageer comprises a card printed with a negative image of a veiled woman's face and a set of instructions for use. The negative image has a generally black face with features marked in white and surrounded by a cowl, itself surrounded completely by a circular black area and further includes four white focussing target dots located in mutually spaced apart relation, two on the middle of the nose and two adjacent and below the tip of the nose. In use, a person gazes at the four dots, preferably without blinking, for approximately one minute, then looks away and stares fixedly at a fixed location on a wall or other plain background, preferably the sky at night. A positive afterimage of the negative image will gradually appear to the person.

7 Claims, 1 Drawing Sheet

OPTICAL NIGHT SKY IMAGEER

FIELD OF THE INVENTION

The invention relates to after image effects and particularly to a device and method for producing after images.

BACKGROUND OF THE INVENTION

Afterimage effects in which a visual response is produced after a visual stimulus has been removed are known but not well understood.

U.S. Pat. No. 4,953,968 issued to Sherwin et al on Sep. 4, 1990 teaches a method and apparatus for testing potentials evoked by visual stimuli; U.S. Pat. No. 5,061,059 issued to Horn on Oct. 29, 1991 teaches a method and apparatus for visual field testing and U.S. Pat. No. 3,772,511 issued to Marban on Nov. 13, 1973 teaches apparatus for simulating a flickering light. However none of the above mentioned patents are indicative of the present invention.

SUMMARY OF THE INVENTION

It is an object of the invention to provide an imaging method and apparatus by which a person can experience a positive afterimage phenomenon from viewing a negative image.

According to one aspect of the invention, there is provided apparatus for producing a positive optical afterimage comprising an image carrier having a negative image of high contrast corresponding to a desired positive afterimage marked on a face of the carrier thereof so as to be within a visual field of a user and a focussing target marked on a generally central location of the negative image.

The invention also provides a method for producing a preselected positive optical afterimage comprising the steps of providing an image carrier; marking the surface of the image carrier with a negative image of high contrast corresponding to the preselected positive afterimage so as to be within a visual field of a user; gazing steadily at an approximately dentral location of the image for a period of at least a few seconds and, preferably one minute, in good light; and subsequently staring fixedly at one of a fixed location and direction on one of a blank wall or other plain background, and the sky at night causing a positive afterimage of the negative image to gradually appear.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figure 1:
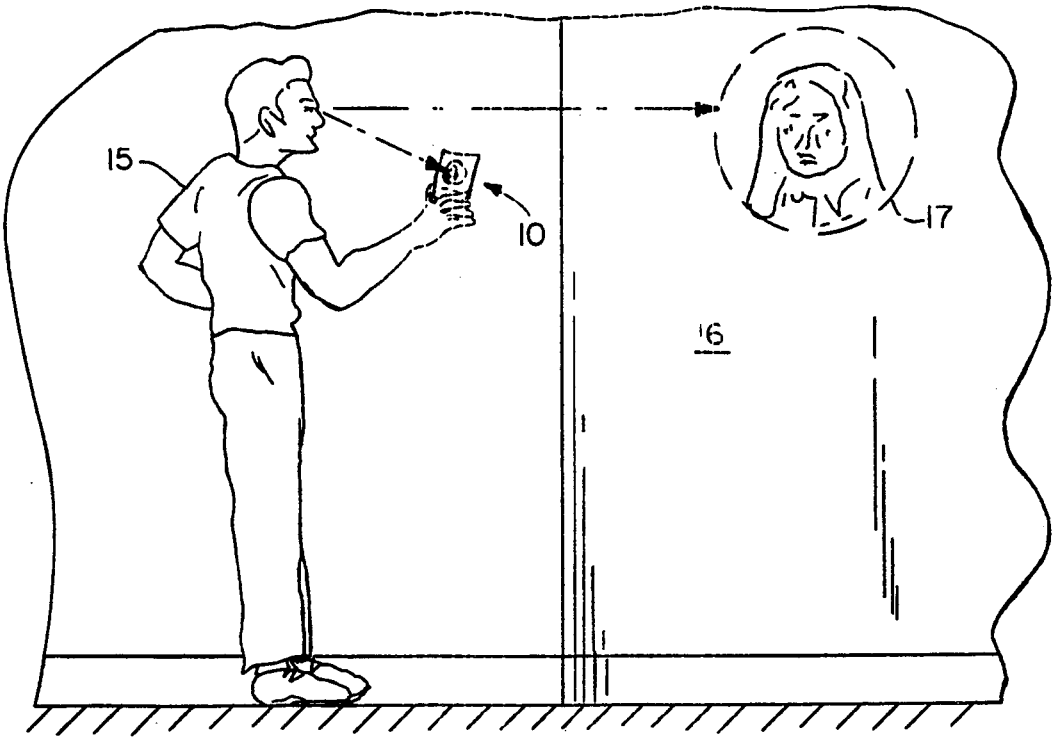
FIG. 1 is a diagrammatic perspective view illustrating the embodiment of the instant invention in use.
Figure 2:
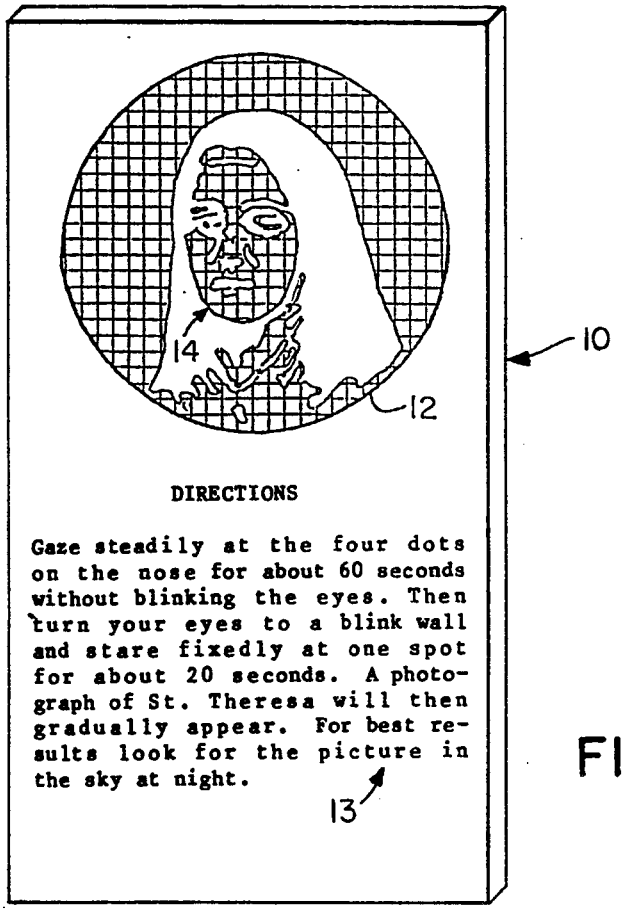
FIG. 2 is a diagrammatic perspective view illustrating the embodiment of the instant invention per se.

Turning now descriptively to the drawings, in which like reference characters denote like elements throughout the several views, the figures of the imaging apparatus comprises a card 10 approximately 2"×3.5" in size having a negative image of a veiled woman's face 12 (St. Theresa) printed or otherwise applied on an upper half of the surface thereof below which are printed and a set of instructions 13 for use. As shown, the negative image has a generally black face with features marked in white and surrounded by a white cowl itself surrounded completely by a circular black area. The card surface itself provides a white background.

The negative image includes four white focussing target dots 14 located in mutually spaced apart relation, two on the middle of the nose and two adjacent and below the tip of the nose.

In use, a person 15 gazes at the four dots 14, preferably without blinking, for one minute, then looks away and stares fixedly at a fixed location on a wall 16 or Other plain background, preferably the sky at night. A positive after image 17 of the negative image will gradually appear to the person.

The period necessary for gazing at the dots 14 can be decreased in very bright direct sunlight to as little as a few seconds for the positive afterimage effect to be experienced.

What is claimed is:

1. An optical imageer article of manufacture for producing a positive optical afterimage comprising an image carrier having a negative image of high contrast corresponding to a desired positive afterimage marked on a face of the carrier thereof so as to be within a visual field of a user and a focussing target marked on a generally central location of the negative image, wherein the negative image is a generally black face with white features and surrounded by a white veil, itself surrounded completely by a circular black area.

2. The optical imageer article of manufacture according to claim 1 in which the focussing target comprises a series of white focussing target dots arranged in mutually spaced apart relation on a dark portion of the negative image.

3. The optical imageer article of manufacture according to claim 1 in which the focussing target comprises four focussing target dots marked in mutually spaced apart relation of the face and on a black portion of the face at an approximately central location, two focussing target dots on the middle of a nose and two focussing target dots adjacent and below the tip of a nose.

4. The optical imageer article of manufacture according to claim 1 in which the image carrier is a card of size 2 inches by 3.5 inches and directions for use are also marked on the surface of the card adjacent the negative image.

5. A method for producing a preselected positive optical afterimage comprising the steps of:

a) providing an image carrier;

b) marking the surface of the image carrier with a negative image of high contrast corresponding to the preselected positive afterimage so as to be within a visual field of a user and having a focusing target at an approximately central location thereof wherein, the negative image is a generally black face with white features and surrounded by a white veil, itself surrounded completely by a circular black area;

c) gazing steadily at an approximately central location of the image for a period of at least a few seconds in good light; and d) subsequently staring fixedly at a plain background, causing a positive afterimage of the negative image to gradually appear.

6. A method according to claim 5 in which the focussing target comprises a series of dots arranged in mutually spaced apart relation on an approximately central location of a black portion of the negative image.

7. The method according to claim 5 in which there are four white focussing target dots marked in mutually spaced apart relation on the approximately central location of a black portion of the face, two focussing target dots on the middle of a nose and two focussing target dots adjacent and below the tip of the nose.

* * * * *